US008262117B2

(12) United States Patent
Knopf et al.

(10) Patent No.: US 8,262,117 B2
(45) Date of Patent: Sep. 11, 2012

(54) WHEELCHAIR COMPRISING A FOOT SUPPORT

(75) Inventors: Michael Knopf, Dielheim (DE); Karsten Dellbruegge, Dedenhofen (DE); Jason Shelton, Fresno, CA (US)

(73) Assignee: Sunrise Medical GmbH & Co. KG, Malsch/Heidelberg (DE)

( * ) Notice: Subject to any disclaimer, the term of this patent is extended or adjusted under 35 U.S.C. 154(b) by 466 days.

(21) Appl. No.: 12/577,603

(22) Filed: Oct. 12, 2009

(65) Prior Publication Data

US 2010/0090437 A1 Apr. 15, 2010

(30) Foreign Application Priority Data

Oct. 10, 2008 (EP) ..... 08166364

(51) Int. Cl.
*A61G 5/12* (2006.01)

(52) U.S. Cl. ..... 280/304.1; 280/291; 297/423.28; 297/DIG. 4

(58) Field of Classification Search ..... 280/304.1, 280/250.1, 288.4, 291; 297/423.22, 423.26, 297/423.28, 423.3, DIG. 4, 423.23, 423.24, 297/423.38; 403/116
See application file for complete search history.

(56) References Cited

U.S. PATENT DOCUMENTS

| | | | | |
|---|---|---|---|---|
| 3,325,215 | A | 6/1967 | Murcott | |
| 3,902,758 | A * | 9/1975 | Pivacek | 297/423.22 |
| 4,634,183 | A * | 1/1987 | Ruiz | 297/423.28 |
| 4,858,260 | A | 8/1989 | Failor et al. | |
| 5,076,602 | A | 12/1991 | Robertson et al. | |
| 5,131,672 | A | 7/1992 | Robertson et al. | |
| 5,143,391 | A | 9/1992 | Robertson et al. | |
| 5,176,393 | A | 1/1993 | Robertson et al. | |
| 5,188,139 | A * | 2/1993 | Garelick | 135/67 |
| 5,253,888 | A * | 10/1993 | Friedrich | 280/250.1 |
| 5,409,247 | A | 4/1995 | Robertson et al. | |
| 5,421,598 | A | 6/1995 | Robertson et al. | |
| 5,593,173 | A * | 1/1997 | Williamson | 280/642 |
| 5,772,234 | A * | 6/1998 | Luo | 280/642 |
| 6,311,999 | B1 | 11/2001 | Kueschall | |
| 6,394,476 | B1 | 5/2002 | Molnar | |
| 6,419,253 | B1 | 7/2002 | Mascari | |
| 6,464,243 | B2 | 10/2002 | Roche | |
| 7,134,678 | B2 | 11/2006 | Lindkvist et al. | |
| 7,222,921 | B2 * | 5/2007 | Farnella et al. | 297/423.26 |

(Continued)

FOREIGN PATENT DOCUMENTS

| | | |
|---|---|---|
| BE | 529233 | 6/1954 |

(Continued)

OTHER PUBLICATIONS

European Search Report for EP08166364.

(Continued)

*Primary Examiner* — Paul N Dickson
*Assistant Examiner* — Wesley Potter
(74) *Attorney, Agent, or Firm* — MacMillan, Sobanski & Todd, LLC

(57) ABSTRACT

A wheelchair comprises a pair of spaced apart side frame tubes and a pair of foot support frames. Each of the foot support frames has a first end configured to connect to the side frame tubes and a second end configured to receive a cross member. The cross member interconnects the second ends of the foot support frames and supports a foot support assembly.

17 Claims, 10 Drawing Sheets

U.S. PATENT DOCUMENTS

| | | | | |
|---|---|---|---|---|
| 7,338,133 | B2 * | 3/2008 | Laffin | 297/466 |
| 7,455,362 | B2 * | 11/2008 | Hanson et al. | 297/363 |
| 2001/0011805 | A1 * | 8/2001 | Kueschall | 280/250.1 |
| 2002/0074765 | A1 * | 6/2002 | Melgarejo et al. | 280/250.1 |
| 2004/0104321 | A1 | 6/2004 | Marsolais et al. | |
| 2005/0168033 | A1 | 8/2005 | Peterson | |
| 2006/0012146 | A1 | 1/2006 | Farnella et al. | |
| 2006/0087098 | A1 | 4/2006 | Peterson et al. | |
| 2006/0087103 | A1 | 4/2006 | Schreiber et al. | |
| 2007/0085301 | A1 | 4/2007 | Watkins | |
| 2008/0067777 | A1 | 3/2008 | Dauw et al. | |
| 2010/0007114 | A1 * | 1/2010 | Papi et al. | 280/304.1 |

FOREIGN PATENT DOCUMENTS

| | | | |
|---|---|---|---|
| CA | 2581578 | A1 | 3/2008 |
| DE | 8906096 | | 7/1989 |
| DE | 29705494 | U1 | 5/1997 |
| DE | 29816998 | | 11/1998 |
| DE | 29901471 | U1 | 7/1999 |
| DE | 19821021 | | 11/1999 |
| DE | 20316246 | U1 | 12/2003 |
| DE | 202004007928 | | 7/2004 |
| EP | 0255804 | | 2/1988 |
| EP | 0329002 | | 8/1989 |
| EP | 0329002 | | 10/1994 |
| EP | 0761195 | A1 | 3/1997 |
| EP | 911009 | | 4/1999 |
| EP | 1116480 | | 7/2001 |
| EP | 1155669 | | 11/2001 |
| EP | 1598041 | | 11/2005 |
| EP | 1721592 | A2 | 11/2006 |
| FR | 2799641 | | 4/2001 |
| GB | 758830 | | 10/1956 |
| JP | 6114454 | | 4/1994 |
| JP | 09285495 | | 11/1997 |
| JP | 2001314452 | | 11/2001 |
| WO | WO9117077 | | 11/1991 |
| WO | WO9308782 | | 5/1993 |
| WO | WO 00/27691 | | 5/2000 |
| WO | WO2006019664 | A1 | 2/2006 |
| WO | WO2007121606 | | 11/2007 |

OTHER PUBLICATIONS

PCT Search Report, Int'l Appl. No. PCT/EP2008/011016.
OFF CARR "fenice" Brochure; downloaded Dec. 17, 2008.

* cited by examiner

WHEELCHAIR COMPRISING A FOOT SUPPORT

CROSS-REFERENCE TO RELATED APPLICATIONS

This application claims priority from European Patent Application No. EP08166364, filed Oct. 10, 2008, the disclosure of which is incorporated herein by reference.

BACKGROUND OF THE INVENTION

This invention relates in general to wheelchairs. In particular, this invention relates to wheelchairs having pivotable footrest structures.

Wheelchairs are a class of personal mobility vehicle that provide greater ambulatory freedom to persons having limited movement abilities. Wheelchairs generally have a frame, a seat assembly, two drive wheels for propelling the vehicle and two pivoting, caster wheels that permit directional control. Wheelchairs also may include a foot support structure, such as a footrest, to permit a user's feet to be supported by the chair. The footrest prevents a user's feet from dragging on the ground and helps maintain the user in a seated position during operation.

In many manually driven wheelchairs, the footrests may be a pair of plates that can be pivoted outward for access to and egress from the chair. Alternatively the footrests may be a single plate or a tubular member that spans between side frame members of the chair. The footrests often extend out from the front of the chair as the forward-most element. This position may make maneuverability in tight spaces difficult or impede ingress and egress from the chair. The forward position of the footrest also shifts the user's center of gravity (CG) forward, such as toward the front caster wheels. This forward shift of the user's CG may make steering more difficult or make the ride harsh and unstable.

When deployed, the footrest provides adequate support for the user's feet. However, the deployed footrest makes ingress and egress from the chair cumbersome. Because of this ingress and egress issue, some footrest structures are pivotable in order to allow a user's foot to have direct access to the ground.

It would be desirable to provide an improved footrest structure for wheelchairs.

SUMMARY OF THE INVENTION

This invention relates to a wheelchair that comprises a pair of spaced apart side frame tubes, a pair of foot support frames and a cross member. The pair of foot support frames each have a first end configured to be telescopically received within the side frame tubes and a second end configured to receive the cross member. The foot support frames are configured so that the cross member is positioned rearward of the foot support frame first ends. The cross member further interconnects the second ends of the foot support frames. A foot support assembly is supported on the cross member.

In another embodiment, the pair of foot support frames of the wheelchair have a first end configured to be connected to the side frame tubes and a second end extending rearwardly. Each of the second ends includes a terminal end. The pair of terminal ends are configured to receive a cross member therebetween. The foot support frames are configured so that the cross member is positioned rearward of the foot support frame first ends. The cross member interconnects the second ends of the foot support frames at the terminal ends. A foot support assembly is pivotally supported on the cross member.

In yet another embodiment of a foot support of a wheelchair, the foot support assembly is pivotally supported on the cross member. The foot support assembly includes at least one foot plate and a foot support frame. The foot support frame has a swivel coupling configured to pivot relative to the cross member and an adjustable stop. The adjustable stop is selectively positioned on the cross member and configured to enable adjustment of the deployed position of the foot plate.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
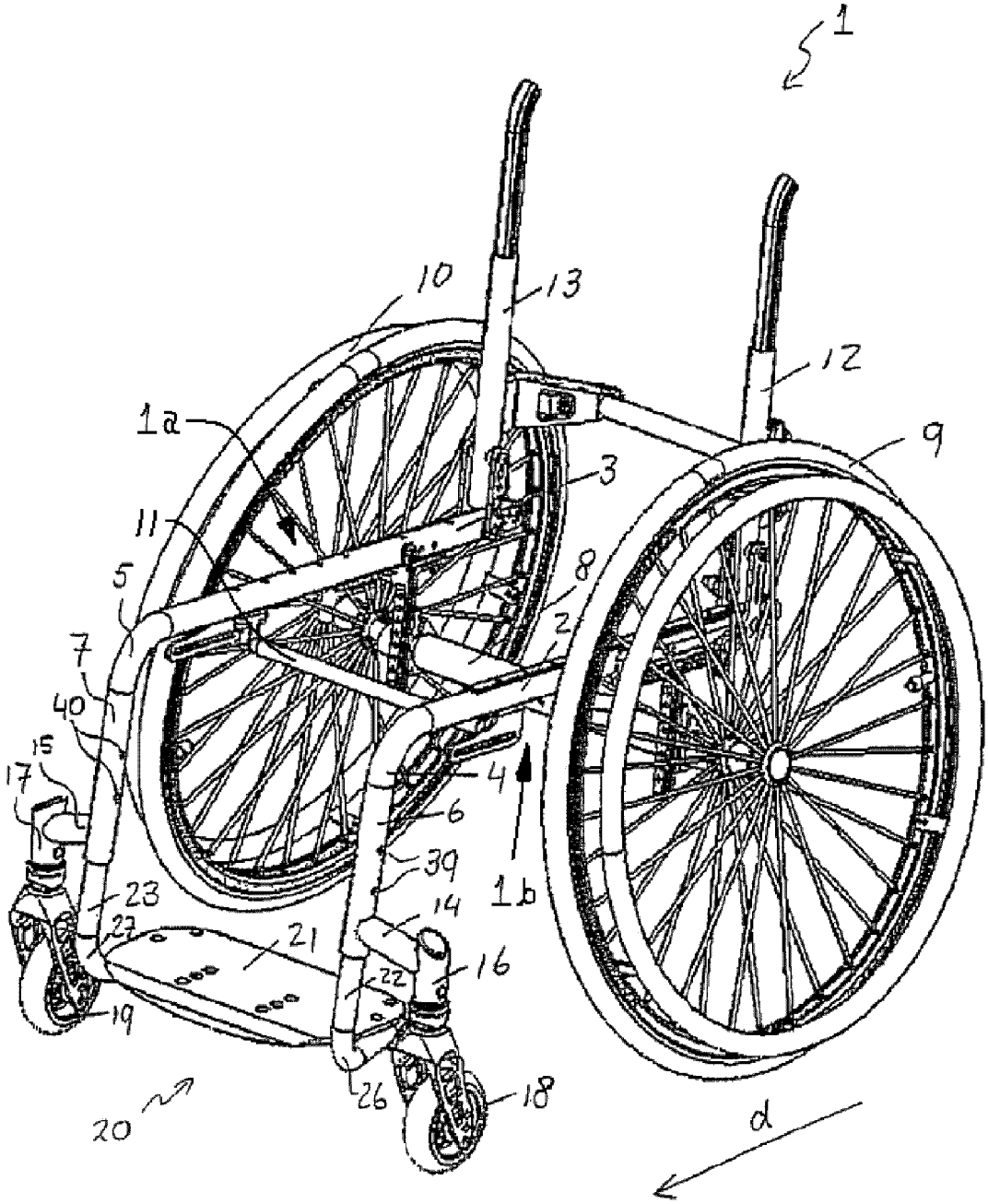
FIG. 1 is a perspective view of a wheelchair, with the seat removed for clarity, having a moveable foot support shown in a deployed position for supporting the feet of a seated user.

Referring now to the drawings, there is illustrated in FIG. 1 a wheelchair 1 comprises a frame which includes left and right L-shaped wheelchair side frame members 1*a* and 1*b*. The side frame members 1*a*, 1*b* are arranged on either side of a central axis aligned with a direction "d" of forward displacement of the wheelchair 1. The wheelchair frame may any type of frame construction but is illustrated, for purposes of explanation only, as an open frame. The left and right L-shaped wheelchair side frame members comprise respective horizontal tube sections 2, 3. The horizontal tube sections 2, 3 are shown oriented with their longitudinal axes generally parallel to the direction "d" of forward displacement of the wheelchair 1. It should be understood, however, that the horizontal tube sections 2, 3 may be oriented in any attitude and/or relative position if desired. The L-shaped wheelchair side frame members 1*a*, 1*b* further comprise bent sections 4, 5 which transition from the horizontal tube sections 2, 3 into leg tube sections 6, 7. The left frame sections 2, 4, 6 and the right frame sections 3, 5, 7 may be formed from a single continuous tube member. Alternatively, the left and right frame sections 2-7 may be separate sections that are assembled together to form the left and right frame sections.

In the illustrated embodiment, an axle arrangement comprises a bracket 8 that is connected between the horizontal tube sections 2, 3. The bracket 8 may act as a structural member to connect the horizontal tube sections 2, 3 together. It should be understood that the horizontal tube sections 2, 3 may be connected together in any number of ways such as, for example, by an interconnecting cross member, a structural seat pan, a folding hinge and cross member arrangement, and the like. The axle arrangement includes rear wheels 9, 10 that are mounted for rotation on the bracket 8. The bracket 8 also positions the rear wheels 9, 10 adjacent to the horizontal tube sections 2, 3 for support of the wheelchair 1 and user. A strut 11 may also be provided to interconnect the horizontal tube sections 2, 3 if desired. The horizontal tube sections 2, 3 are arranged to support a seat or a seat frame (not shown). Seat back support members 12, 13 extend from the horizontal tube sections 2,3 in a generally upright direction to support a backrest (not shown). The seat back support members 12, 13 may be fixed in position or may be adjustable to any attitude or longitudinal position relative to the horizontal tube sections 2, 3.

Front caster mounts 14, 15 are illustrated as extending laterally from the leg tube sections 6, 7, though other mounting constructions, such as a caster mounting tube that extends from a portion of the horizontal tube sections 2, 3 or the bent sections 4, 5 may be used if desired. The front caster mounts 14, 15 are rigidly connected to the leg tube sections 6, 7 at one end. The connection of the leg tube sections 6, 7 may be a permanent connection or may be an integrally formed, continuous part of the leg tube sections 6, 7, though such configurations are not required. A caster assembly 16, 17 may include a housing, a pivot assembly, and a caster fork for a front caster wheel 18, 19. The caster assembly 16, 17 may be fixed to the front caster mounts 14,15 or may be formed as a single, integral component. The leg tube sections 6, 7, along with the front portion of the wheelchair 1, are supported by the front caster wheels 18, 19.

The leg tube sections 6, 7 of the L-shaped wheelchair side frame members are interconnected at the ends of the L-shaped wheelchair frame members by a foot support assembly 20. By not requiring an additional cross member between the leg tube sections 6, 7, the wheelchair frame is configured to allow a user's legs to be comfortably positioned between the leg tube sections 6,7. This open structure allows a user who has some lower leg control to be able to push or otherwise "walk" the wheelchair in a seated position with his legs. Because the front wheel supports 14,15 extend laterally from the leg tube sections 6,7 with respect to the direction "d" of forward displacement of the wheelchair 1, the leg tube sections 6, 7 can be placed relatively close together to provide lateral support to a user's legs.

Figure 2:
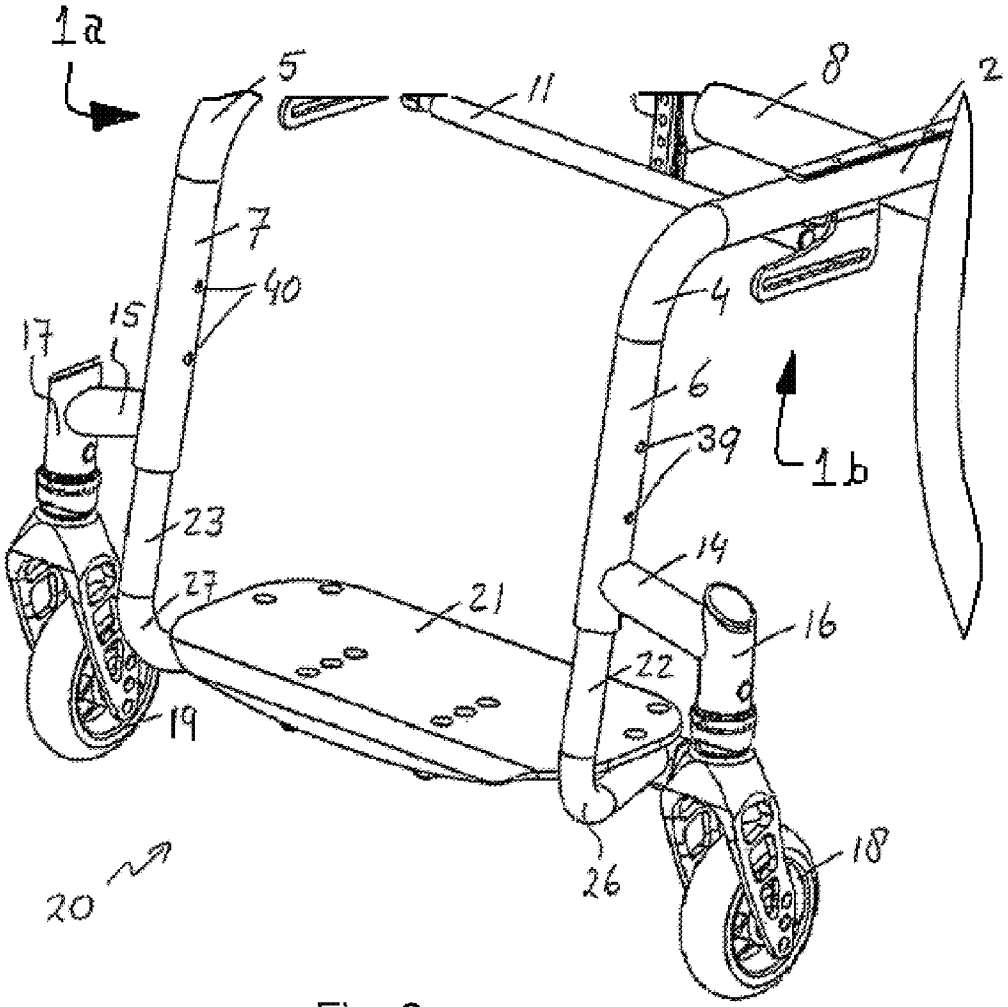
FIG. 2 is an enlarged perspective view of the moveable foot support of FIG. 1.
Figure 3:
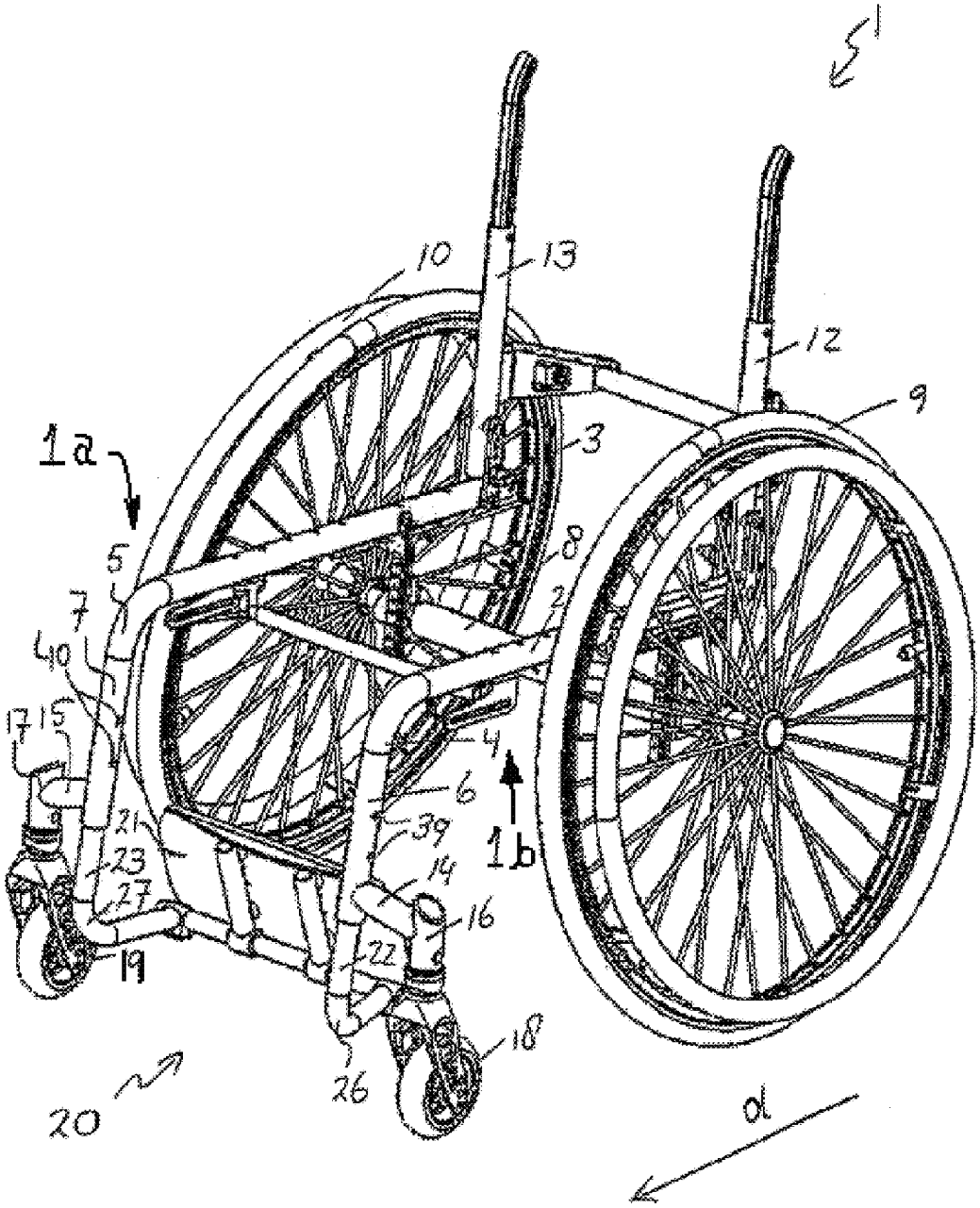
FIG. 3 is a perspective view of the wheelchair of FIG. 1 with the moveable foot plate moved toward a stowed position.
Figure 4:
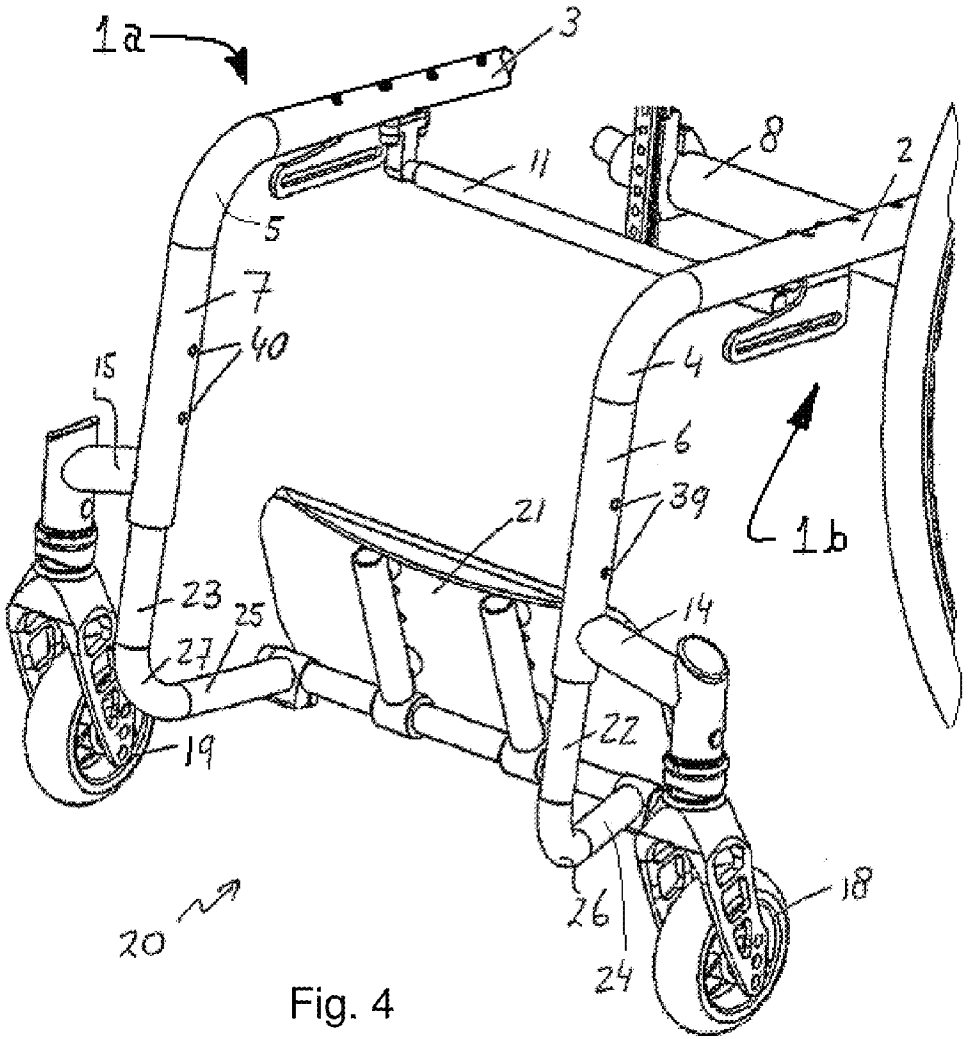
FIG. 4 is an enlarged perspective view of the moveable foot support of FIG. 3.

As shown in FIGS. 2 and 4, a foot support assembly 20 comprises a foot plate 21 that can be pivoted about an axis that is generally transverse to the direction "d" of forward movement and to the leg tube sections 6, 7 of the L-shaped wheelchair side frame members 1*a*, 1*b*. This axis is situated adjacent a rear portion of the foot plate 21, as will be described below in detail. Thus, the foot plate 21 may be pivoted to a stowed position, where the foot plate 21 is moved toward a generally upright position or beyond an upright position. With the foot plate 21 pivoted to or toward the stowed position, as shown in FIGS. 3 and 4, the ground, floor, or other support surface is exposed allowing the user to stand between the left and right wheelchair frame members 1*a*, 1*b*. By being able to stand just in front of the seat, with the user's feet on the ground, the user may more freely move in and out of the wheelchair 1.

Figure 5:
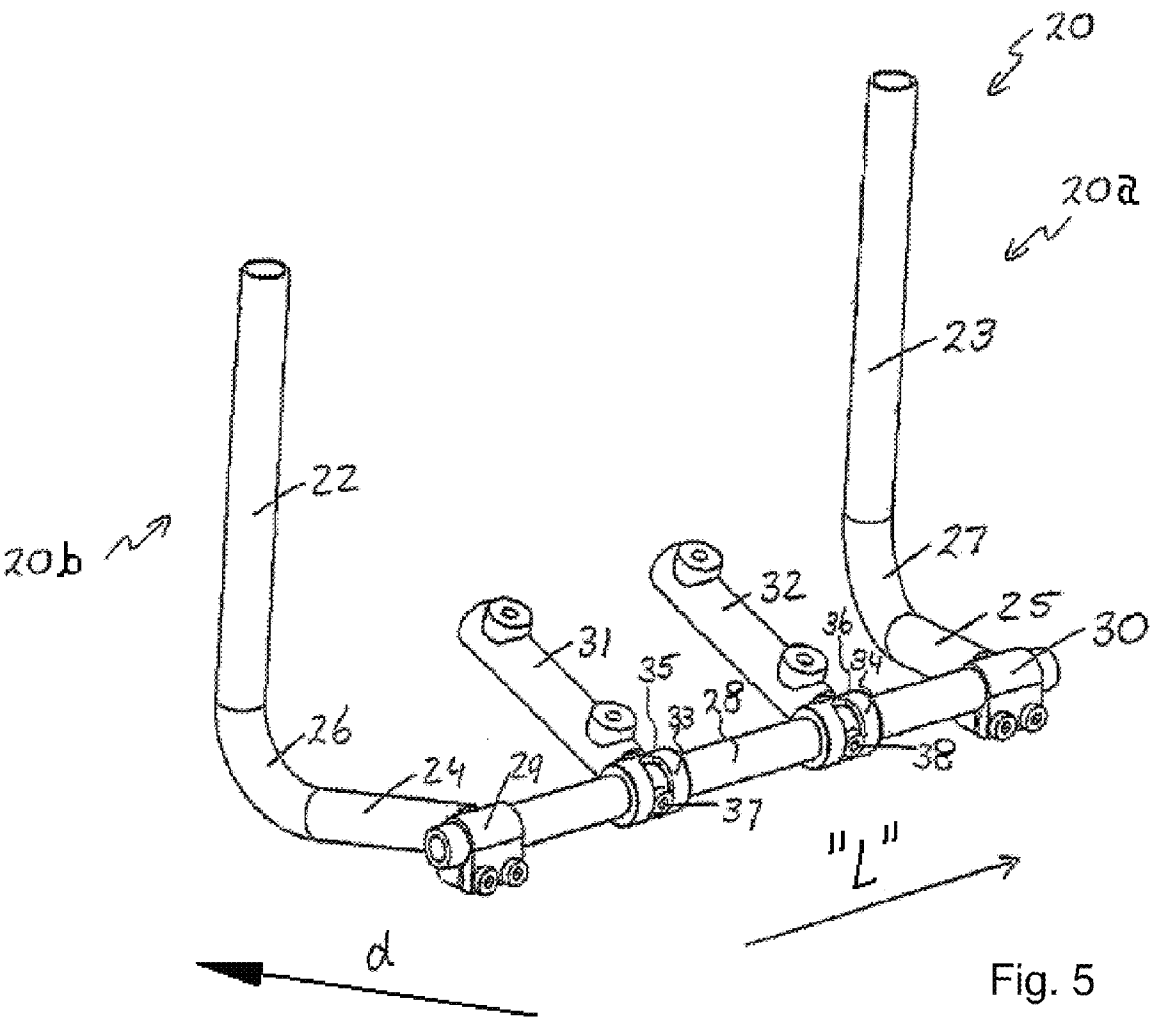
FIG. 5 is an enlarged perspective view of a frame of the moveable foot support, with the foot plate removed for clarity.

Referring now to FIG. 5, the foot support assembly 20 comprises left and right, generally L-shaped frame members 20*a* and 20*b* that include left and right vertical sections 22, 23; left and right, horizontal sections 24, 25; and left and right elbow sections 26, 27. Though sections 22, 23, 24, and 25 are referred to as "vertical" and "horizontal," these sections are not limited to these particular attitudes or relative orientations but may have any suitable orientation. The bends forming the left and right elbow sections 26, 27 transition the left and right vertical sections 22, 23 into the left and right horizontal sections 24, 25. This transition eliminates sharp edges and angles at the junctions between the left and right vertical sections 22, 23 and the left and right horizontal sections 24, 25 thereby providing a smooth structure that is less inclined to interfere with the user. This safety feature is further enhanced by the use of frame parts comprising tubes with round, oval or essentially circular, cross-sections. Alternatively, other tube cross-sectional shapes (i.e., square, hexagonal, lemon-shaped, and the like) may be used if desired.

As shown in the illustrated embodiment of FIG. 5, the elbow sections 26,27 are bent to direct the left and right horizontal sections 24, 25 generally towards the rear of the wheelchair 1 with respect to the direction "d" of forward movement. The horizontal sections 24, 25 may also point generally towards (or alternatively away from) the center of the wheelchair 1 as they extend rearwardly, if so desired. The rearward extension of the horizontal sections 24, 25 behind the caster wheels 18, 19 improves the weight distribution of the wheelchair 1 in the occupied state. If the user's feet were supported forward of the leg tube sections 6, 7 more weight would be typically transferred to the front caster wheels 18, 19.

Referring again to FIG. 5, the horizontal sections 24, 25 are connected to a cross-member 28 that extends between the left and right frame members 1*a* and 1*b*. The connection is made with a left clamp 29 and a right clamp 30. The left and right clamps 29, 30 interconnect the cross-member 28 with the left and right horizontal sections 24, 25. The cross-member 28 further supports the foot plate 21. The left and right clamps 29, 30 are shown in circumferential engagement with the cross-member 28 and frictionally retain the relative cross-member position. The right and left clamps 29, include fasteners to provide the necessary clamp force for interconnecting the cross-member 28 with other portions of the foot support frame members 20*a*, 20*b*. Though illustrated as circumferential clamps, the left and right clamps 29, 30 may be any suitable structure to retain the cross-member to the foot support frame members 20*a*, 20*b* and maintain the desired relative orientation. For example, the clamps 29, 30 may be travelers in rails, ratchet-and-pawl assemblies, structures providing a shape lock instead of a friction lock, and the like. In other embodiments, the clamps 29, 30 may be structures that separately provide for selectively allowing and arresting longitudinal and rotary movement of the cross-member 28. For example, in such an embodiment of the clamps 29, 30, width adjustment of the left and right frame members 6, 7 may be accommodated and the inclination adjustment of the footplate 21 remains fixed, being provided by another structure, e.g. a hinge.

When engaged, the clamps 29, 30 provide a generally rigid connection between the left and right horizontal sections 24, 25 and the cross-member 28 to prevent relative movement therebetween. When released, the clamps 29, 30 are movable relative to the cross-member 28 in a direction "L" that is parallel to a longitudinal axis of the cross-member 28 and generally perpendicular to direction "d". This allows adjustment of the width of the wheelchair 1. The clamps 29, 30, when released, also allow rotation of the cross-member 28 about its longitudinal axis. This is used to adjust the angle of inclination of the foot plate 21 relative to the horizontal plane when in the deployed position for supporting the user's feet.

In an alternative embodiment, the cross-member 28 may be a plurality of cross-members that may be telescopically engaged and selectively fixable together. Alternatively, the plurality of cross-members may not each interconnect the left and right horizontal sections 24, 25 directly. In such an arrangement, horizontal sections 24, 25 may be interconnected by the plurality of cross-members and the footplate 21, or a further part that supports the footplate 21. Alternatively, the footplate 21 may be two foot plates arranged side-by-side and supported by a single cross-member 28.

As shown in FIG. 5, the footplate 21 is supported for rotation about the cross-member 28 by two support members 31, 32. The support members 31, 32 are fixed to the underside of the foot plate 21. Though shown as two separate structures, the support members 31, 32 may be a single support such as, for example, a "U" shaped member. The support members 31, 32 include pivot mounts or swivel couplers 33, 34 that are supported for rotation about the cross-member 28. As shown in FIG. 5, the support members 31, 32 extend in a generally transverse direction from the cross-member 28. The swivel couplers 33, 34 allow the assembly of the support members 31, 32 and the footplate 21 to pivot about the cross-member 28 between the deployed and stowed positions. These positions are defined by slots 35, 36 that extend partially around the swivel couplers 33, 34.

Pins 37, 38 are fixed to the cross-member 28 and located within the slots 35, 36. The pins 37, 38 abut the ends of the slots 35, 36 and define stop points that establish the inclination of the footplate 21 in the deployed and stowed positions. The stowed and deployed positions of the footplate 21 are adjustable by releasing the clamps 29, 30 and rotating the cross-member 28 about its longitudinal axis, thereby changing the positions of the pins 37, 38 relative to an arbitrary position, such as a horizontal position. It will be appreciated that the pins 37, 38 and slots 35, 36 may alternatively be configured as one or more projections arranged on the cross-member 28 that abut other portions of the swivel couplers 33, 34. For example, one or more projections arranged adjacent to the swivel couplers 33, 34 can engage one or more projections extending from the swivel couplers 33, 34.

Referring again to FIGS. 2 and 4, the leg tube sections 6, 7 engage the left and right vertical sections 22, 23 for selective, relative telescopic movement. Adjustment locks 39, 40 are provided to fix leg tube sections 6, 7 relative to the vertical sections 22, 23 to provide an incremental height adjustment of the front of the wheelchair 1. The adjustment locks 39, 40 may be configured as, for example, cooperating apertures and spring-loaded pins or apertures and bolts or screws, and the like. A height adjustment capability may also be provided between the rear wheels 9, and the horizontal tube sections 2, 3. Though shown as being telescoping members, the vertical sections 22, 23 and the leg tube sections 6, 7 may be arranged side-by-side and configured for selective relative movement to increase the amount of height adjustment capability.

The various adjustment mechanisms described above, in combination with the pivotable footplate 21, provide a relatively versatile wheelchair with a construction that allows weight savings to be made without sacrificing the rigidity of the frame. Thus, the seated user's weight and center of gravity is positioned relative to the wheels 9, 10, 18, and 19 in such a way that good stability can be achieved.

Figure 6:
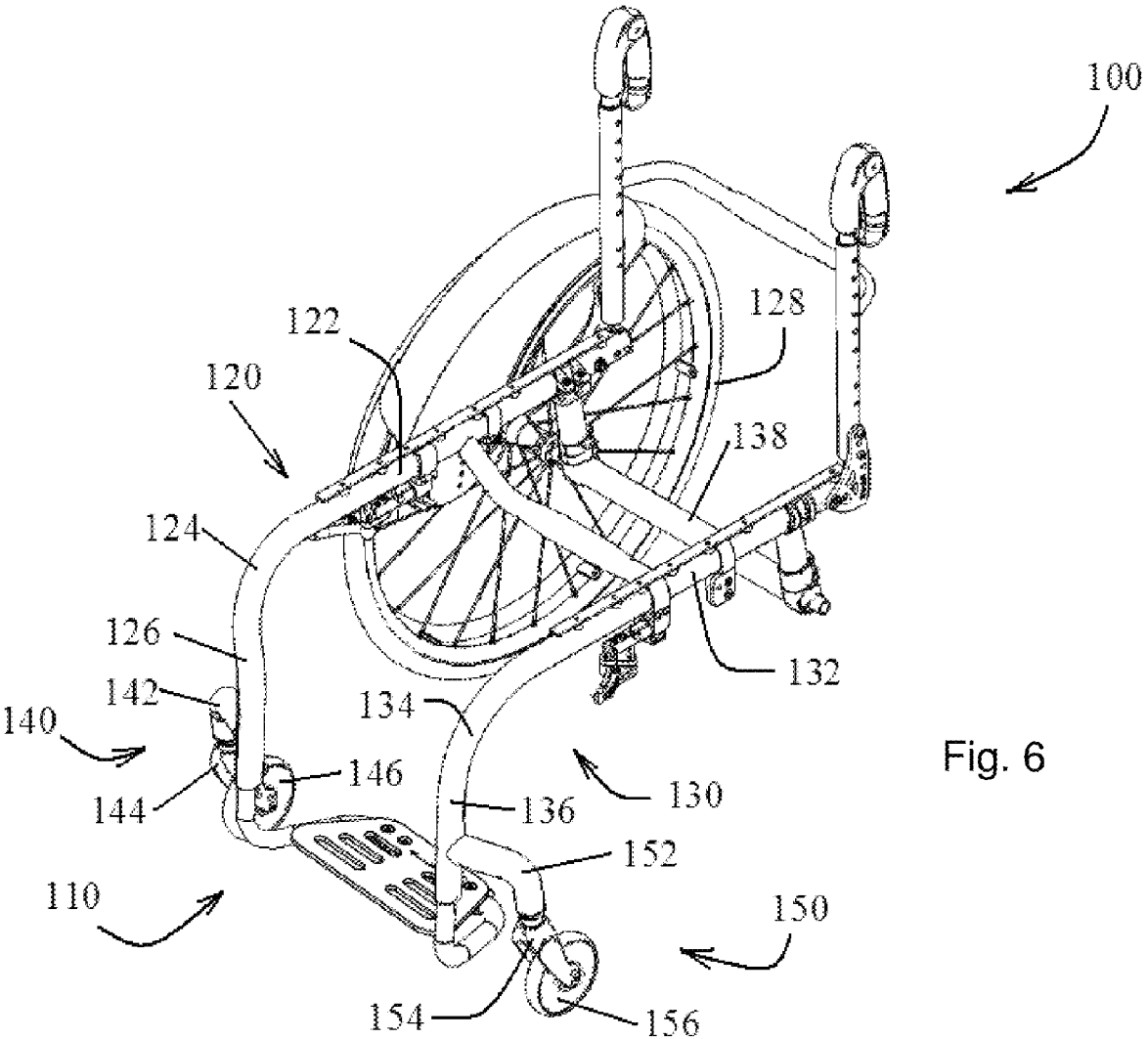
FIG. 6 is an alternative embodiment of a wheelchair having a moveable foot support shown in a deployed position for supporting the feet of a seated user.

Referring now to FIG. 6, there is illustrated another embodiment of a wheelchair, shown generally at 100. The wheelchair 100 is illustrated having an embodiment of a pivotable foot support assembly, shown generally at 110. The wheelchair 100 also may include many common elements and features of the wheelchair 1 described above. It should be understood that any feature or element described herein may be combined with any other features or elements to provide various embodiments of a wheelchair in accordance with the disclosure.

The wheelchair 100 includes spaced apart, right and left side frame members, shown generally at 120 and 130, respectively. The right side frame member is illustrated having a horizontal tube section 122, a bent section 124, and a leg tube section 126. The left side frame member 130 includes a horizontal tube section 132, a bent section 134, and a leg tube section 136 that are generally complimentary in shape and orientation. The right and left horizontal tube sections 122, 132 are supported by right and left rear wheels, though only the right rear wheel 128 is illustrated. An axle assembly 138 supports the right and left rear wheels for rotation relative to the right and left side frame members 120, 130.

Right and left caster assemblies 140 and 150 are illustrated extending in a general lateral direction from the leg tube sections 126 and 136, respectively. The right and left caster assemblies 140, 150 include caster tubes 142, 152, pivot forks 144, 154 and front caster wheels 146, 156. The caster tubes 142, 152 are illustrated as continuously bent tube sections, having no sharp corners or edges.

Figure 7:
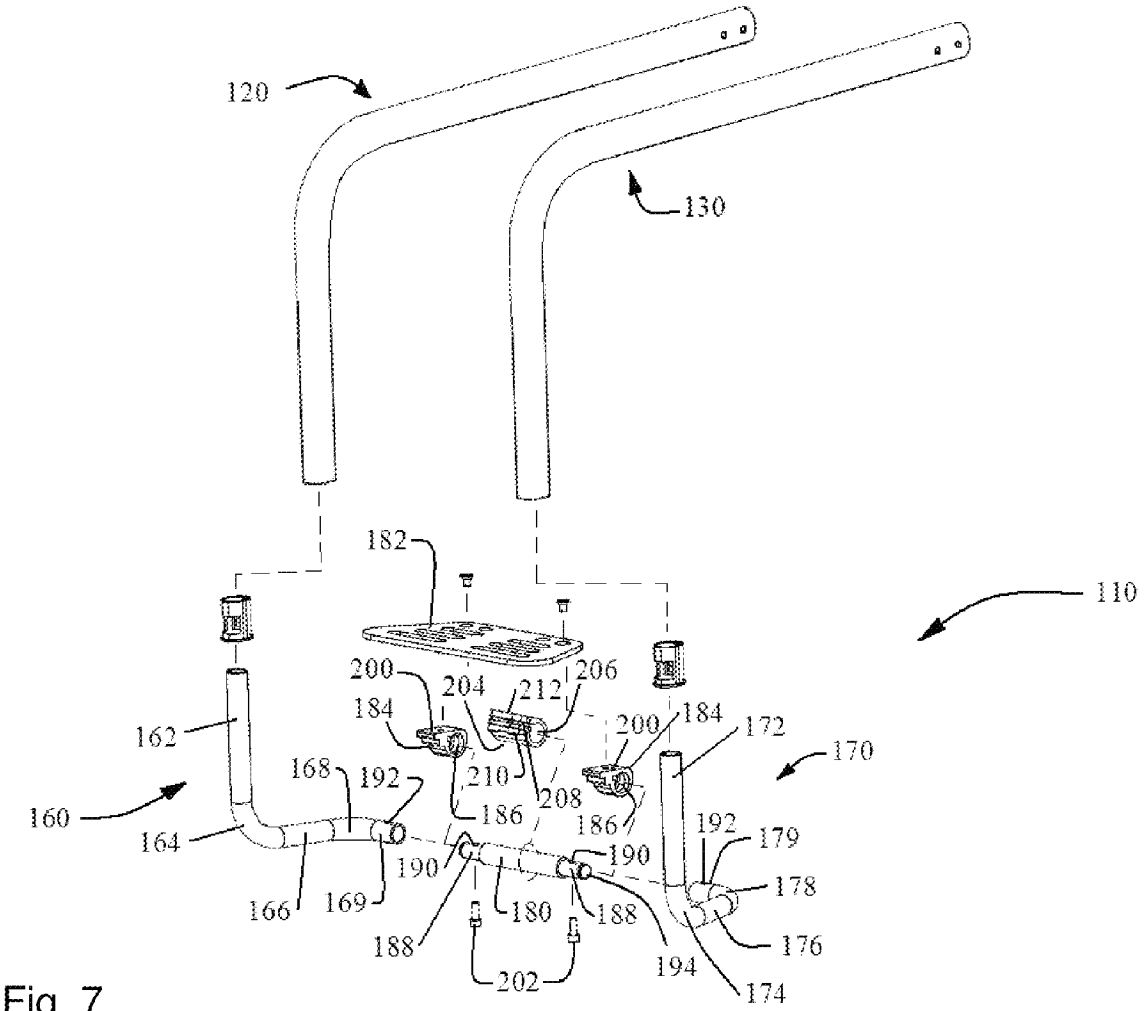
FIG. 7 is an exploded view of an embodiment of a foot support structure.

Referring now to FIG. 7, there is illustrated an exploded view of the foot support assembly 110 and right and left frame members 120, 130. The foot support assembly includes right and left foot support frame members 160, 170. The right foot support frame member 160 is illustrated as a generally L-shaped member that includes a vertical section 162, a first elbow section 164, a horizontal section 166, and a second elbow section 168. The right foot support frame member 160 includes a terminal end 169 that extends from the second elbow section 168 and is configured to support one end of a cross-member 180. The left foot support frame member 170 includes a vertical section 172, a first elbow section 174, a horizontal section 176, and a second elbow section 178 that are illustrated as complimentary in shape and orientation. The left foot support frame member 170 likewise includes a terminal end 179 configured to support the other end of the cross-member 180.

Figure 8A:
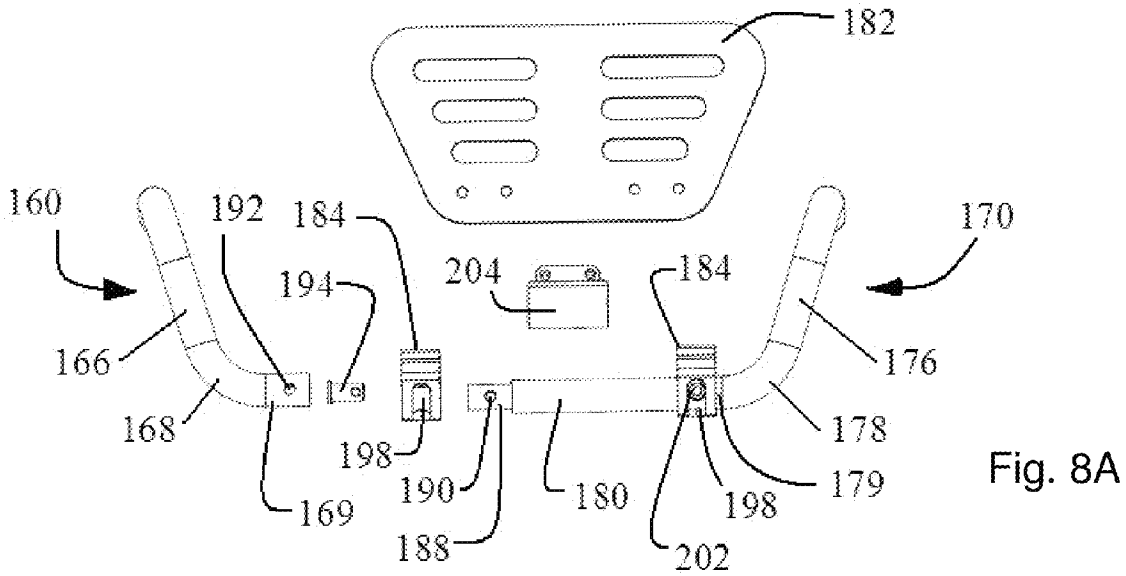
FIG. 8A is an enlarged, exploded view of an embodiment of a moveable foot support structure.

The foot support assembly 110 includes a footplate 182 that is supported on the cross member 180 for relative pivotal movement. As shown in FIGS. 7, and 8A, the footplate 182 is attached to a pair of spaced apart pivot mounts 184. The pivot mounts 184 each include a pivot bore 186 that is supported for relative rotational movement on an outer surface of each of the terminal ends 169, 179. A cross member mounting journal 188 is shown extending from each end of the cross member 180. Alternatively, the cross member mounting journals 188 may extend from the terminal ends 169, 179 if so desired. Each of the cross member mounting journals 188 has an attachment aperture 190, that may extend through the opposite side, though such is not required. The terminal ends 169, 179 have an attachment aperture 192, that optionally may also be formed through to the opposite side.

Figure 8B:
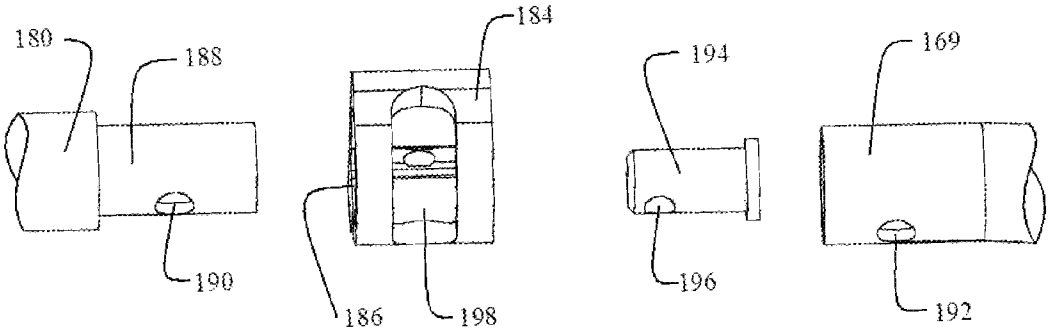
FIG. 8B is an enlarged, exploded view of a pivot mount of the moveable foot support of FIG. 8A.

As illustrated in FIG. 8B, a mounting plug 194 includes a threaded aperture 196 and is adapted to be positioned within a central opening of the cross member mounting journal 188. When the plug 194 is positioned in the mounting journal 188 the aperture 190 is aligned with the threaded aperture 196. The pivot mount 184 includes a positioning slot 198 formed across from a footplate mounting pad 200, configured to support the footplate 182. The positioning slot 198 is aligned with the aligned apertures 190, 192 of the cross member mounting journals 188 and the terminal end 192. A bolt 202, illustrated as an allen-head cap screw in FIG. 7, extends through the coaxially aligned apertures 190, 192 and the positioning slot 198. The bolt 202 threads into engagement with the threaded aperture 196 and secured the cross member 180 to the terminal ends 169, 179 of the right and left foot support frame members 160, 170. The head of the bolt 202 is aligned within the positioning slot 198. The bolt 202 prevents the pivot members 184 from moving axially along the cross member 180 but allow pivotal rotation. The ends of the positioning slots 198 form rotational stops at the ends of the slots that limit rotational movement of the pivot members 184 at the extreme deployed and stowed positions of the footplate 182.

Referring again to FIGS. 7 and 8A, the foot support assembly 110 further includes an adjustable footplate stop 204. The adjustable footplate stop 204 is illustrated as a wrap-around compression clamp having a bore 206 and a slot 208. At least one clamping fastener 210 extends through apertures (one threaded, one not threaded) and across the slot 208. The footplate stop 204 is shown having a footplate rest surface 212 that supports the footplate 182 at an inclined to allow the user to comfortably rest his feet. The foot plate stop 204 is optional. As shown in FIG. 7, the cross member 180 extends through the bore 206 of the stop 204. The stop 204 may be rotated about the outer surface of the cross member 180 until the footplate rest surface 212 is positioned at the desired attitude of the footplate 182. The clamping fastener 210 is then tightened so that the adjustable stop 204 frictionally engages the cross member 180. The footplate 182 may rest on the footplate rest surface 212 which is generally coplanar with the footplate mounting pad 200. The adjustable footplate stop 204 thus defines an angle of inclination that establishes a user-preferred deployed position of the footplate 182.

Figure 9A:
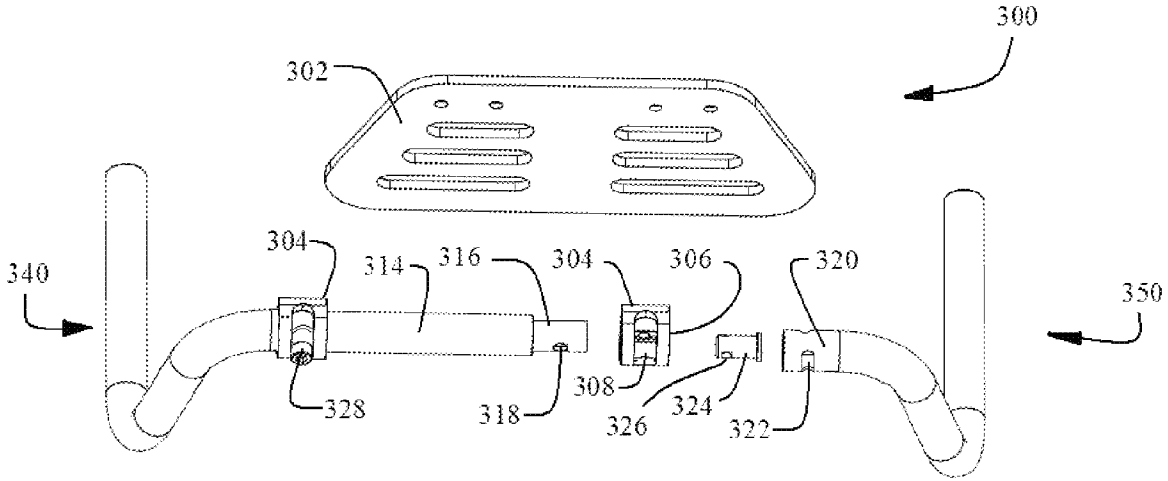
FIG. 9A is an enlarged, exploded view of another embodiment of a moveable foot support structure.
Figure 9B:
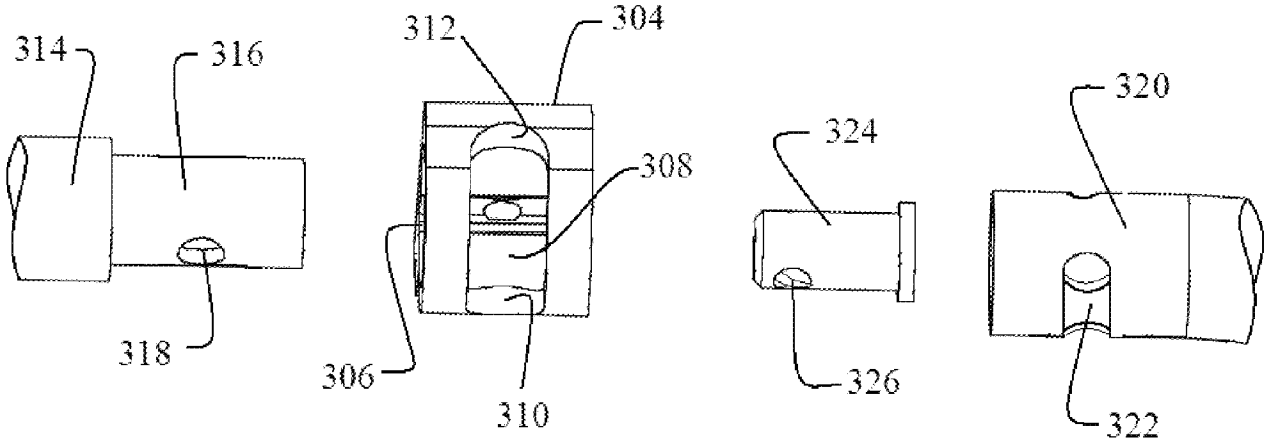
FIG. 9B is an enlarged, exploded view of a pivot mount of the moveable foot support of FIG. 9A.

Referring now to FIGS. 9A and 9B, there is illustrated another embodiment of a foot support assembly, shown generally at 300. The foot support assembly 300 has a footplate 302 attached to at least one pivot mount 304. The pivot mount 304 may be a pair of spaced apart pivot mounts 304, as shown in FIGS. 9A and 9B. The pivot mounts are configured similarly to the pivot mounts 184 described above and include a bore 306 and a positioning slot 308 that terminates in end stops 310 and 312. The bore 306 of the pivot mount 304 is supported for rotation on a cross member 314 in a manner similar to that described above.

The cross member 314 is illustrated having a cross member mounting journal 316 at each end. Each of the cross member mounting journals 316 has at least one aperture 318 formed therethrough, similar to aperture 190 described above. The mounting journal 316 engages a terminal end 320 of left foot support frame member 350. The right foot frame support member 340 is similarly configured and engaged with the cross member 314. The terminal end 320 includes an arcuate slot 322 that extends around a portion of the terminal end 320. Alternatively, the two slots 322 may be formed having equal length arcs and spaced 180 degrees apart. A mounting plug 324 includes a threaded aperture 326 and is adapted to be positioned within a central opening of the cross member mounting journal 316. A bolt 328, similar to bolt 202 above, secures the cross member mounting journal 316 to the terminal end 320 by way of the plug 324, similar to that described above.

Figure 10B:
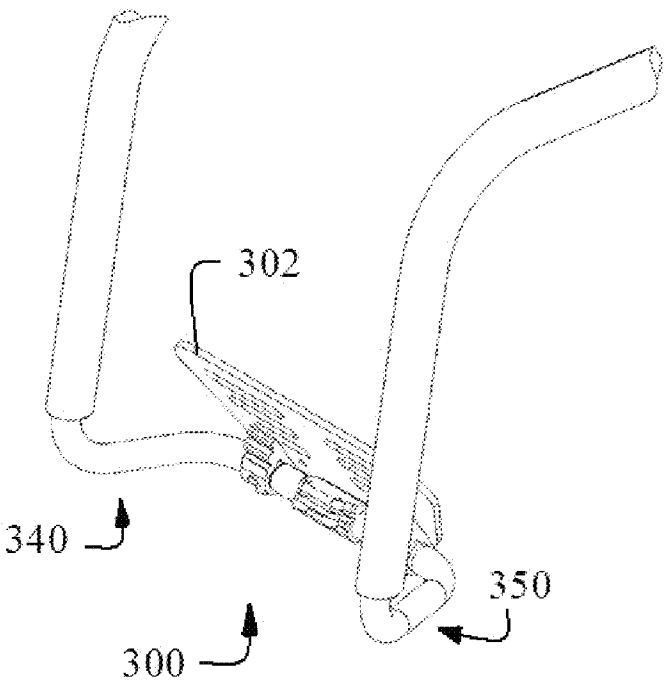
FIG. 10B is a perspective view of the foot support of FIG. 10A moved toward a stowed position.
Figure 10A:
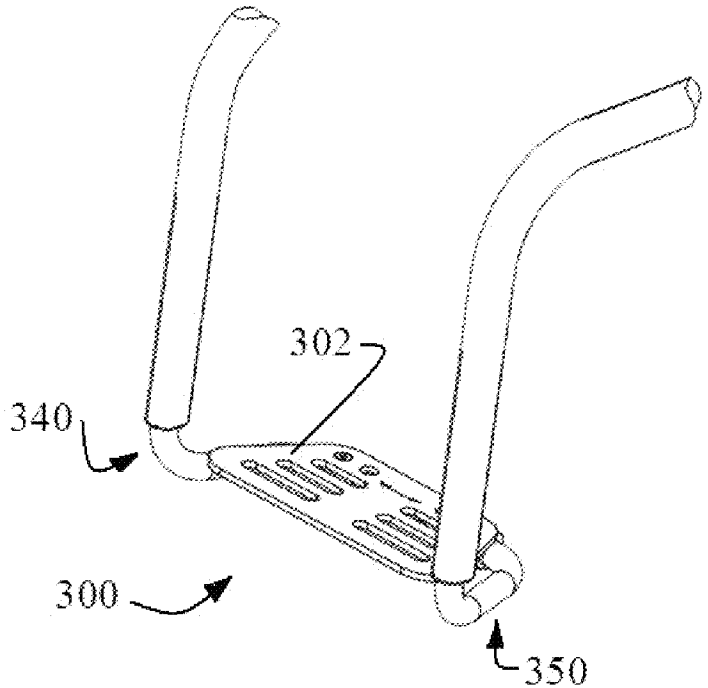
FIG. 10A is a perspective view of the foot support of FIG. 8A in a deployed position.

In the embodiment of the foot support assembly 300 of FIGS. 9A and 9B, when the bolt 328 is loosened, the cross member 314, plug 342 and bolt 328 are free to rotate relative to the terminal end 320. The bolt 328 may be moved within the slot 322 to adjust the rotational orientation of the cross member 314 and the head of the bolt 328 relative to the right and left foot frame support members 340, 350. The head of the bolt 328 defines the angle of inclination of the deployed and stowed positions of the footplate 302 similar to the embodiment of the foot plate 21 describe above. FIG. 10A shows the foot plate 302 in a deployed position. FIG. 10B shows the footplate 302 moved toward a stowed position, thus opening the floor space between the right and left foot frame support members 340, 350 for a user's feet.

The invention is not limited to the embodiments described above, but can be varied within the scope of the accompanying claims. Features of the invention as disclosed in the description, claims and drawings may be essential to its implementation individually or in any combination. For example, the cross-member 28 may be positioned at any location under the rear half of the foot plate 21, and in one embodiment, this position may be variable.

What is claimed is:

1. A wheelchair comprising:

a pair of spaced apart side frame tubes;

a pair of foot support frames each having a first end configured to be telescopically received within the side frame tubes and a second end configured to receive a cross member, the foot support frames being configured so that the cross member is positioned rearward of the foot support frame first ends, the cross member further interconnecting the second ends of the foot support frames; and a foot support assembly including at least one footplate attached to at least one pivot mount that is supported on the cross member for relative pivotal movement on the cross member through a range of motion, the pivot mount including a positioning slot configured to limit rotational movement of the footplate relative to the cross member and prevent lateral movement of the footplate relative to the cross member.

2. The wheelchair of claim 1 wherein a pin cooperates with the pivot mount to limit the range of motion between a deployed position and a stowed position.

3. The wheelchair of claim 1 wherein the at least one pivot mount includes a positioning slot and the cross member includes a projection, the cross member being selectively rotatable relative to the foot support frames to adjust the orientation of the projection to alter the deployed and stowed positions of the footplate relative to the foot support frames.

4. A wheelchair comprising:

a pair of spaced apart side frame tubes;

a pair of foot support frames each having a first end configured to be connected to leg tube sections of the side frame tubes and a second end extending rearwardly relative to the leg tube sections and including a terminal end, the pair of terminal ends configured to receive a cross member therebetween, the foot support frames being configured so that the cross member is positioned rearward of the foot support frame first ends, the cross member further interconnecting the second ends of the foot support frames and including one of a projection and an adjustable stop; and a foot support assembly pivotally supported on the cross member such that the one of the projection and the adjustable stop establishes a foot support assembly deployed position.

5. The wheelchair of claim 4 wherein the first ends of the foot support frames are configured to telescope relative to the side frame tubes.

6. The wheelchair of claim 4 wherein the pair of terminal ends face each other and the cross member is received between the facing terminal ends.

7. The wheelchair of claim 4 wherein the cross member includes the adjustable stop, and the adjustable stop is supported on the cross member for selective rotation relative to the cross member, the adjustable stop defining the deployed position of a foot plate.

8. The wheelchair of claim 4 wherein the foot support assembly includes at least one footplate that is supported for pivotal movement on the cross member, the footplate being attached to at least one pivot mount, the pivot mount configured to rotate relative to the cross member between the deployed position and a stowed position.

9. The wheelchair of claim 8 wherein the at least one pivot mount includes a positioning slot and the cross member includes the projection, the cross member being selectively rotatable relative to the foot support frames to adjust the orientation of the projection to alter the deployed and stowed positions of the footplate relative to the foot support frames.

10. The wheelchair of claim 9 wherein an adjustable stop is supported on the cross member for selective rotation relative to the cross member, the adjustable stop configured to define an inclination of the footplate between the deployed position and the stowed position.

11. A wheelchair comprising:

a pair of spaced apart side frame tubes;

a pair of foot support frames each having a first end configured to be connected to the side frame tubes and a second end configured to receive a cross member such that the cross member is positioned rearward of the foot support frame first ends, the cross member further interconnecting the second ends of the foot support frames; and a foot support assembly pivotally supported on the cross member, the foot support assembly including at least one foot plate and a support member, the support member having a pivot mount configured to pivot relative to the cross member, and an adjustable stop selectively positioned on the cross member and configured to enable adjustment of the deployed position of the foot plate.

12. The wheelchair of claim 11 wherein the second end of the foot support frames have terminal ends that face each other and the cross member is received between the facing terminal ends.

13. The wheelchair of claim 12 wherein the pivot mount pivotally supports the footplate on one of the cross member and the terminal end of the foot support frame, the pivot mount having a positioning slot and the cross member including a projection that cooperates with the positioning slot to define a range of motion of the footplate, the cross member being selectively rotatable relative to the foot support frames to adjust the orientation of the projection to alter the deployed and stowed positions of the footplate relative to the foot support frames.

14. The wheelchair of claim 12 wherein the pivot mount pivotally supports the footplate on one of the cross member and the terminal end of the foot support frame, the pivot mount having a positioning slot and the cross member including a bolt that cooperates with the positioning slot to define a range of motion of the footplate, the cross member being fixed to the facing terminal end of the foot support frame by the bolt.

15. A wheelchair comprising:

a pair of spaced apart side frame tubes;

a pair of foot support frames and a cross member, the foot support frames each having a first end configured to be connected to the side frame tubes and a second end configured to receive the cross member, the cross member interconnecting the second ends of the foot support frames; and a foot support assembly having a footplate that is supported on the cross member for selective rotational movement, the cross member further supporting a stop that supports the footplate in a deployed position.

16. The wheelchair of claim 15 wherein at least one pivot mount is supported for rotational movement on the cross member, the pivot mount includes a positioning slot having at least one end stop that defines the stop, the stop being configured to support the footplate in the deployed position, and the cross member includes a projection.

17. The wheelchair of claim 15 wherein the stop is an adjustable stop that is supported for selective rotational movement about the cross member to adjust an angle of inclination of the foot plate that is more inclined than the deployed position of the footplate.

* * * * *